US009588455B2

(12) United States Patent
Yokoi

(10) Patent No.: US 9,588,455 B2
(45) Date of Patent: Mar. 7, 2017

(54) IMAGE FORMING APPARATUS

(71) Applicant: BROTHER KOGYO KABUSHIKI KAISHA, Nagoya-shi, Aichi-ken (JP)

(72) Inventor: Junichi Yokoi, Nagoya (JP)

(73) Assignee: BROTHER KOGYO KABUSHIKI KAISHA, Nagoya-Shi, Aichi-Ken (JP)

( * ) Notice: Subject to any disclaimer, the term of this patent is extended or adjusted under 35 U.S.C. 154(b) by 0 days.

(21) Appl. No.: 14/607,335

(22) Filed: Jan. 28, 2015

(65) Prior Publication Data

US 2015/0212449 A1 Jul. 30, 2015

(30) Foreign Application Priority Data

Jan. 30, 2014 (JP) ..... 2014-016000

(51) Int. Cl.
*B41J 2/165* (2006.01)
*G03G 15/043* (2006.01)

(52) U.S. Cl.
CPC ..... *G03G 15/043* (2013.01)

(58) Field of Classification Search
None
See application file for complete search history.

(56) References Cited

U.S. PATENT DOCUMENTS 5,600,408 A 2/1997 Horiuchi et al.
2011/0043592 A1* 2/2011 Kinoshita ..... G06K 15/1247 347/236
2012/0195608 A1* 8/2012 Yokoi ..... B41J 2/45 399/51

FOREIGN PATENT DOCUMENTS

JP 8-82987 A 3/1996
JP 8-258328 A 10/1996
JP 2007-090548 A 4/2007

* cited by examiner

*Primary Examiner* — Alejandro Valencia
(74) *Attorney, Agent, or Firm* — Merchant & Gould P.C.

(57) ABSTRACT

An image forming apparatus includes exposing units, a photoconductor, developing units, a processor, and a memory storing instructions. Each exposing unit includes light emitting elements arranged in a main scanning direction and divided into blocks each illuminating at a corresponding light emitting time point. The instructions cause the image forming apparatus to: change a light emitting time point for one of two blocks contained in respective two exposing units at the same position in the main scanning direction, to reduce an image distance in a sub-scanning direction between two images each to be formed by illumination of at least one light emitting element contained in a corresponding one of the two blocks; illuminate the light emitting elements of each of the exposing units at light emitting time points including the light emitting time point obtained by the change; and develop electrostatic latent images formed on the photoconductor.

8 Claims, 12 Drawing Sheets

IMAGE FORMING APPARATUS

CROSS REFERENCE TO RELATED APPLICATION

The present application claims priority from Japanese Patent Application No. 2014-016000, which was filed on Jan. 30, 2014, the disclosure of which is herein incorporated by reference in its entirety.

BACKGROUND

Technical Field

The following disclosure relates to a technique for forming a multicolored image.

Description of the Related Art

There is conventionally known an image forming apparatus which includes an LED line head having a plurality of LED array chips mounted thereon and which is capable of changing a time point of writing of at least one of the LED array chips to seemingly reduce a positional difference between the LED array chips in a sub-scanning direction.

SUMMARY

In one aspect of the disclosure, an image forming apparatus includes: a plurality of exposing units each including a plurality of light emitting elements arranged in a main scanning direction, the plurality of light emitting elements being divided into a plurality of blocks each containing at least one light emitting element, all of the at least one light emitting element illuminating at a light emitting time point set for said each of the plurality of blocks; a photoconductor; a plurality of developing units each including a developing material of a set specific color; a processor; and a memory storing a plurality of instructions. The plurality of instructions, when executed by the processor, cause the image forming apparatus to execute: a first change processing in which the image forming apparatus makes a change in a light emitting time point for one of two blocks contained in respective two exposing units of the plurality of exposing units and located at an identical position in the main scanning direction, such that an image distance which is a distance in a sub-scanning direction between two images each to be formed by illumination of at least one light emitting element contained in a corresponding one of the two blocks at a corresponding one of light emitting time points is less when the at least one light emitting element illuminates at a light emitting time point obtained by the change than when the at least one light emitting element illuminates at a light emitting time point which is not changed by the change; an illuminating processing in which the plurality of light emitting elements of each of the plurality of exposing units illuminate at light emitting time points including the light emitting time point obtained by the change in the first change processing; and a developing processing in which each of electrostatic latent images formed on the photoconductor in the illuminating processing is developed with a developing material of the set specific color which is included in a corresponding one of the plurality of developing units.

In another aspect of the disclosure, an image forming apparatus includes: a plurality of exposing units each including a plurality of light emitting elements arranged in a main scanning direction, the plurality of light emitting elements being divided into a plurality of blocks each containing at least one light emitting element, all of the at least one light emitting element illuminating at a light emitting time point set for said each of the plurality of blocks; a photoconductor; a plurality of developing units each including a developing material of a set specific color; and a controller. The controller is configured to: make a change in a light emitting time point for one of two blocks contained in respective two exposing units of the plurality of exposing units and located at an identical position in the main scanning direction, such that an image distance which is a distance in a sub-scanning direction between two images each to be formed by illumination of at least one light emitting element contained in a corresponding one of the two blocks at a corresponding one of light emitting time points is less when the at least one light emitting element illuminates at a light emitting time point obtained by the change than when the at least one light emitting element illuminates at a light emitting time point which is not changed by the change; control the plurality of light emitting elements of each of the plurality of exposing units to illuminate at light emitting time points including the light emitting time point obtained by the change; and cause each of electrostatic latent images formed on the photoconductor in the illumination to be developed with a developing material of the set specific color which is included in a corresponding one of the plurality of developing units.

BRIEF DESCRIPTION OF THE DRAWINGS

The objects, features, advantages, and technical and industrial significance of the present disclosure will be better understood by reading the following detailed description of the embodiments, when considered in connection with the accompanying drawings, in which.

DETAILED DESCRIPTION OF THE EMBODIMENTS

First Embodiment

Hereinafter, there will be described a first embodiment by reference to FIGS. 1-10.

(1) Overall Construction of Printer

Figure 1:
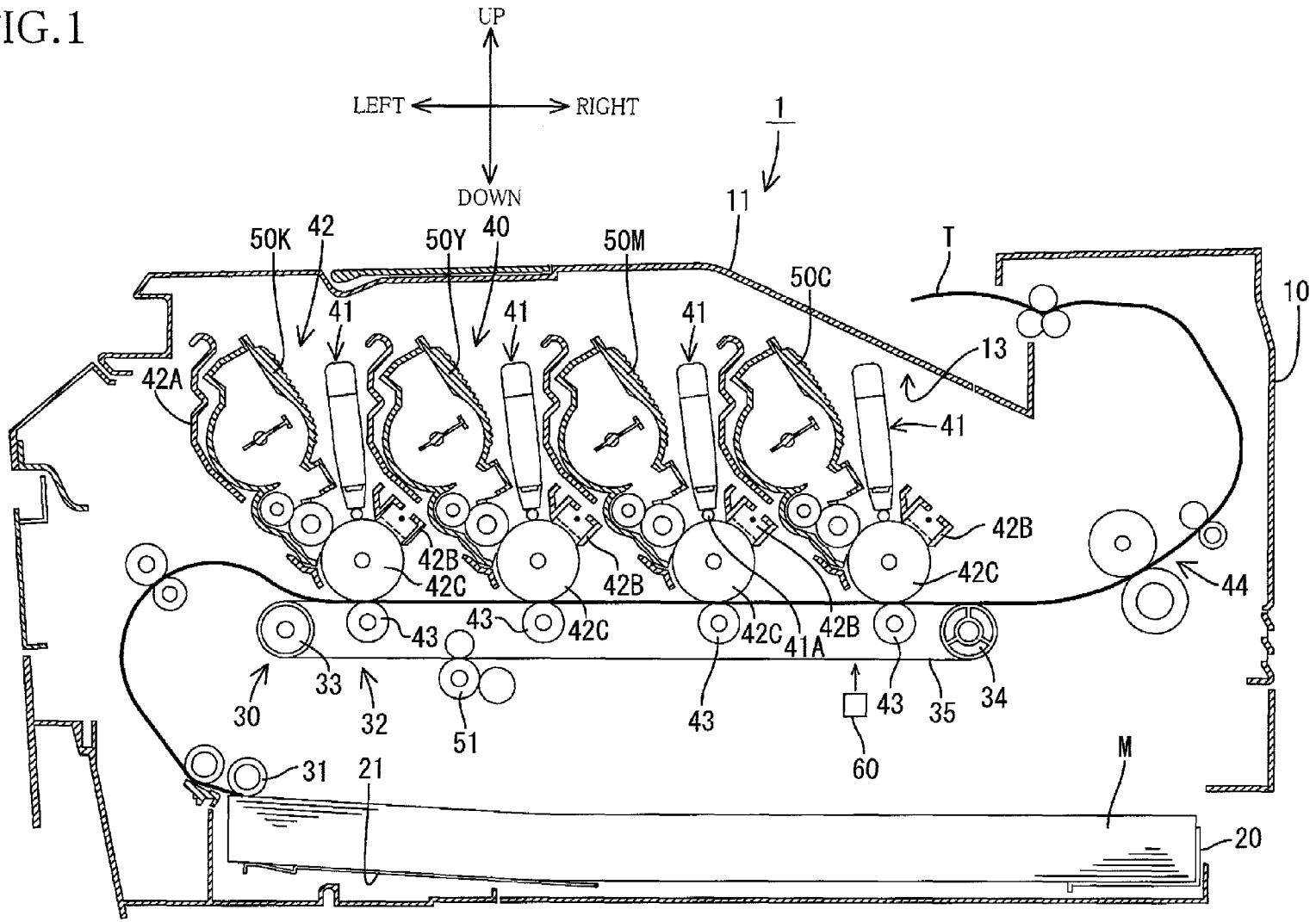
FIG. 1 is a cross-sectional view illustrating an overall construction of a printer according to a first embodiment.

There will be explained, with reference to FIG. 1, an overall construction of a printer 1 as one example of an image forming apparatus according to the first embodiment.

The printer 1 is a color LED printer as a direct transfer tandem printer which uses toner of four colors, namely, black (K), yellow (Y), magenta (M), and cyan (C), to form a color image on a recording medium M such as a printing sheet. The toner is one example of a developing material.

The printer 1 includes a body casing 10, a sheet storage 20, a conveying device 30, and an image forming device 40. The body casing 10 is shaped like a box whose upper face has an opening 13. The body casing 10 is provided with an open/close cover 11 for opening and closing the opening 13.

The sheet storage 20 can be pulled out from the body casing 10 and has a sheet tray 21 for supporting a plurality of recording media M thereon. The sheet tray 21 is urged upward by a spring, not shown, so that an uppermost one of the recording media M stacked on the sheet tray 21 is held in pressing contact with a pickup roller 31.

The conveying device 30 includes the pickup roller 31, a belt unit 32, and other conveying rollers. The conveying device 30 conveys the recording media M one by one from the sheet storage 20 along a conveyance path T.

The belt unit 32 includes: a drive roller 33; a driven roller 34; an endless conveyor belt 35 looped over these rollers; and a drive motor, not shown, for rotating the drive roller 33. In the following description, a conveying direction in which the recording medium M is conveyed will be referred to as "sub-scanning direction". In FIG. 1, a direction perpendicular to a sheet surface is a main scanning direction perpendicular to the conveying direction.

The image forming device 40 includes a plurality of exposing units 41, a process cartridge 42, a plurality of transfer rollers 43, and a fixing unit 44. The process cartridge 42 includes a cartridge frame 42A, four charging units 42B, and four photoconductive drums 42C. It is noted that the following explanation is given for the devices for one color for the sake of simplicity unless otherwise required by context.

The exposing unit 41 includes an LED head 80 (see FIG. 3) having a plurality of LEDs 83 (see FIG. 3) arranged in the main scanning direction. The exposing unit 41 exposes an outer peripheral surface of the photoconductive drum 42C by illumination of the LEDs 83 based on image signals supplied from a controller 70 (see FIG. 2). The exposing unit 41 is provided on the open/close cover 11, so that when the open/close cover 11 is opened, the exposing unit 41 is moved upward together.

The photoconductive drum 42C is one example of a photoconductor.

The cartridge frame 42A is removably mounted on the printer 1. Toner cartridges 50 (50K, 50Y, 50M, 50C) are removably mounted on the cartridge frame 42A, and these toner cartridges 50 correspond to the respective four colors, namely, black (K), yellow (Y), magenta (M), and cyan (C). The toner cartridge 50 is one example of a developing unit.

The charging unit 42B is a scorotron charging unit, for example, and positively charges the outer peripheral surface of the photoconductive drum 42C uniformly. After the outer peripheral surface of the photoconductive drum 42C is electrically charged by the charging unit 42B, light emitted from the exposing unit 41 exposes the outer peripheral surface of the photoconductive drum 42C, so that an electrostatic latent image is formed on the outer peripheral surface of the photoconductive drum 42C. The electrostatic latent image formed on the outer peripheral surface of the photoconductive drum 42C is developed by the toner supplied from the toner cartridge 50, so that a toner image is borne on the surface of the photoconductive drum 42C.

Each of the transfer rollers 43 is opposed to a corresponding one of the photoconductive drums 42C, with the conveyor belt 35 interposed therebetween. When the recording medium M being conveyed on the belt unit 32 passes through a transfer position between the photoconductive drum 42C and each transfer roller 43, a negative transfer bias is applied to the transfer roller 43, so that the toner image borne on the surface of the photoconductive drum 42C is transferred onto the recording medium M.

The fixing unit 44 uses heat to fix the transferred toner image on the recording medium M. The recording medium M on which the toner image is thermally fixed is discharged onto a sheet-output tray constituted by the open/close cover 11.

A detector 60 includes two optical sensors 60A, 60B (see FIG. 5) spaced apart from each other in the main scanning direction. Each of these optical sensors includes: a light emitter configured to emit light to an outer peripheral surface of the conveyor belt 35; and a light receiver configured to receive light emitted from the light emitter and reflected from the outer peripheral surface of the conveyor belt 35. Each sensor sends the controller 70 an electric signal related to intensity of the light received by the light receiver.

(2) Electric Configuration of Printer

Figure 2:
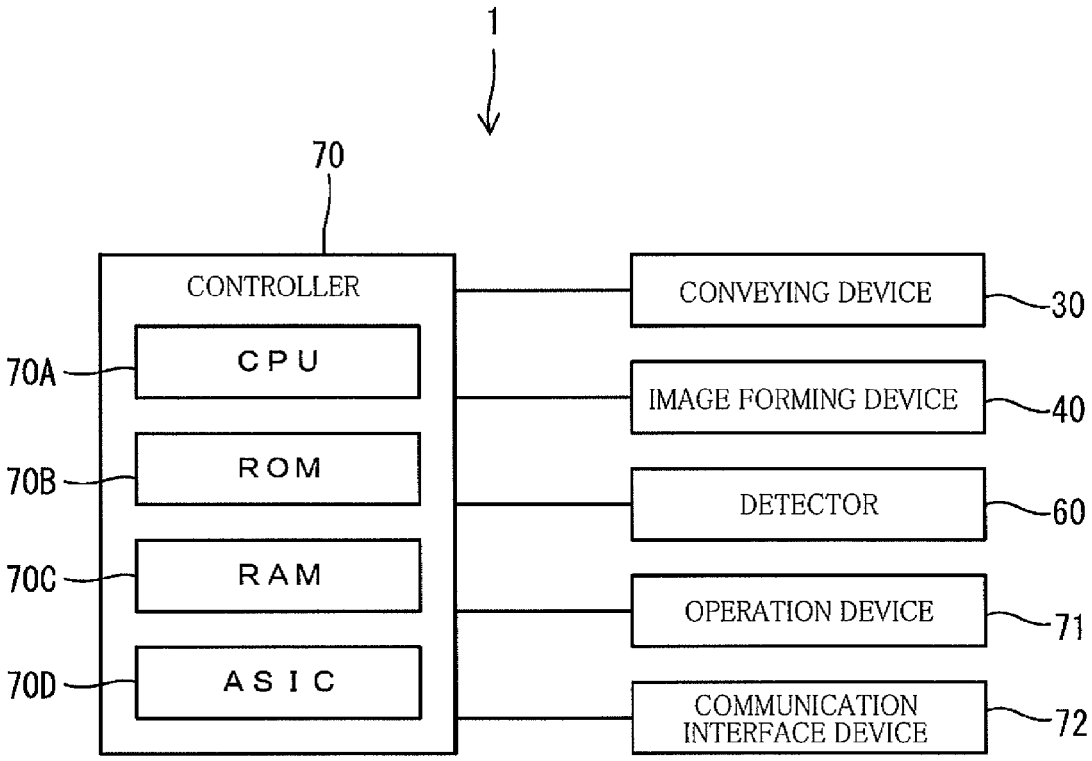
FIG. 2 is a block diagram illustrating an electric configuration of the printer.

As illustrated in FIG. 2, the printer 1 includes the controller 70, the conveying device 30, the image forming device 40, the detector 60, an operation device 71, and a communication interface device 72. Each of the conveying device 30, the image forming device 40, and the detector 60 is constructed as described above.

The controller 70 includes a CPU 70A, a ROM 70B, a RAM 70C, and an ASIC 70D. The CPU 70A controls devices and components of the printer 1 by executing control programs stored in the ROM 70B. The ROM 70B stores the control programs to be executed by the CPU 70A, various kinds of data, and so on. The RAM 70C is used as a main storage when the CPU 70A executes various processings. The RAM 70C is one example of a memory.

The operation device 71 includes various operation buttons and a display device such as a liquid crystal display. The user can operate the operation device 71 to perform various settings and the like.

The communication interface device 72 is hardware for communicating with an external device over a communication line such as a USB (Universal Serial Bus), a LAN (Local Area Network), and Internet. The communication interface device 72 receives an image forming job from the external device over the communication line.

(3) Structure of LED Head 80

Figure 3:
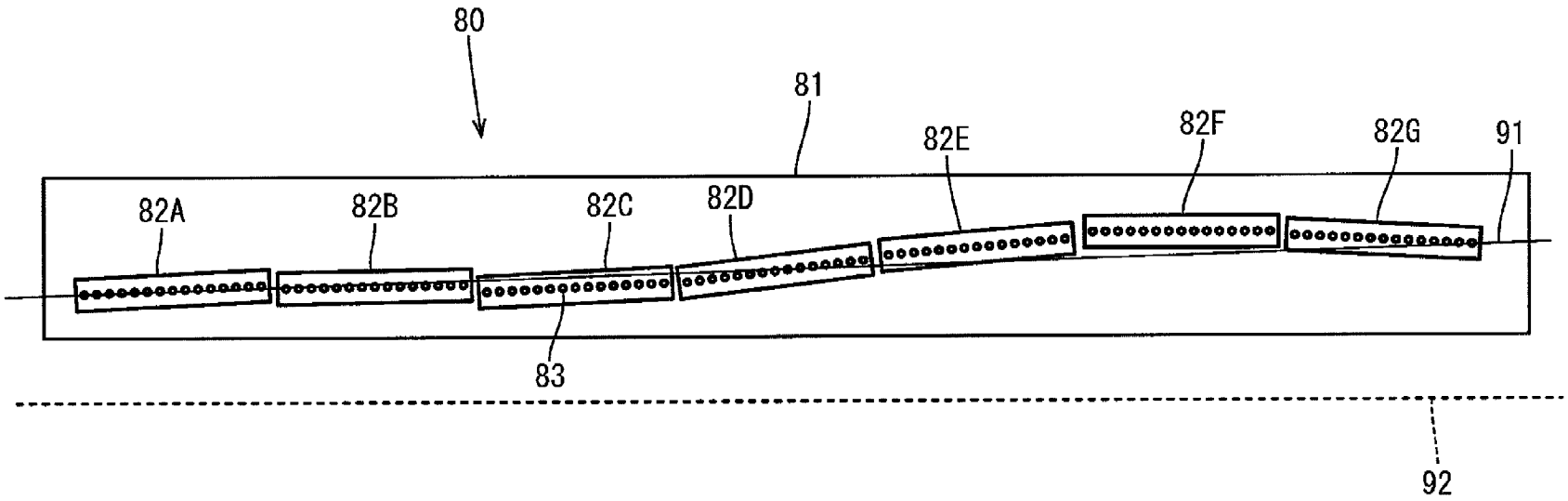
FIG. 3 is a schematic view illustrating an LED head.

There will be next explained a structure of the LED head 80 with reference to FIG. 3. The LED head 80 includes a circuit board 81 shaped like an elongated plate. A plurality of LED chips 82A-82G are disposed on the circuit board 81. Here, the LED head 80 in the present embodiment includes twenty LED chips 82, but FIG. 3 illustrates only seven LED chips 82 for simplicity. It is noted that the number of the LED chips 82 is not limited to twenty. The LED chip 82 is one example of a light emitting chip. In the following description, each of the LED chips 82A-82G will be simply referred to as "LED chip 82" in the case where the LED chips 82A-82G do not differentiate therebetween.

Each of the LED chips 82 includes a plurality of LEDs 83 arranged in a straight line. The number of LEDs 83 provided on one LED chip 82 is 256, for example. The LED 83 is one example of a light emitting element.

It is generally difficult to mount the LED chips 82 onto the circuit board 81 such that all the LED chips 82 are arranged completely in a straight line. In most cases, accordingly, misalignment is caused between the LED chips 82 in the sub-scanning direction, and one or more of the LED chips 82 are inclined with respect to the main scanning direction. In particular, as illustrated in FIG. 3, the LED chips 82 are frequently arranged so as to curve in the sub-scanning direction due to characteristics of a chip mounter. In general, a manner of the curvature varies from one LED head 80 to another. In the present embodiment, the LED heads 80 for KYMC have the same structure, but it is assumed that a manner of the curvature varies from one LED head 80 to another. It is noted that the LED heads 80 for KYMC may be hereinafter referred to as "KYMC LED heads 80", and this way of reference applies to the LED head 80 for each color.

In FIG. 3, a chip reference line 91 is a straight line that connects between two of the LEDs 83 on the LED head 80, which two are respectively located on opposite outermost sides in the longitudinal direction of the LED head 80 among the LEDs 83. A reference line 92 indicates an ideal position at which the chip reference line 91 should be located. The chip reference line 91 is displaced from the reference line 92 due to positional error in assembling of the LED head 80 onto the printer 1 and a change in position of the LED head 80 which is caused by, e.g., vibrations during opening and closing of the open/close cover 11.

(4) Curvature Correction for Each Block

Figure 4:
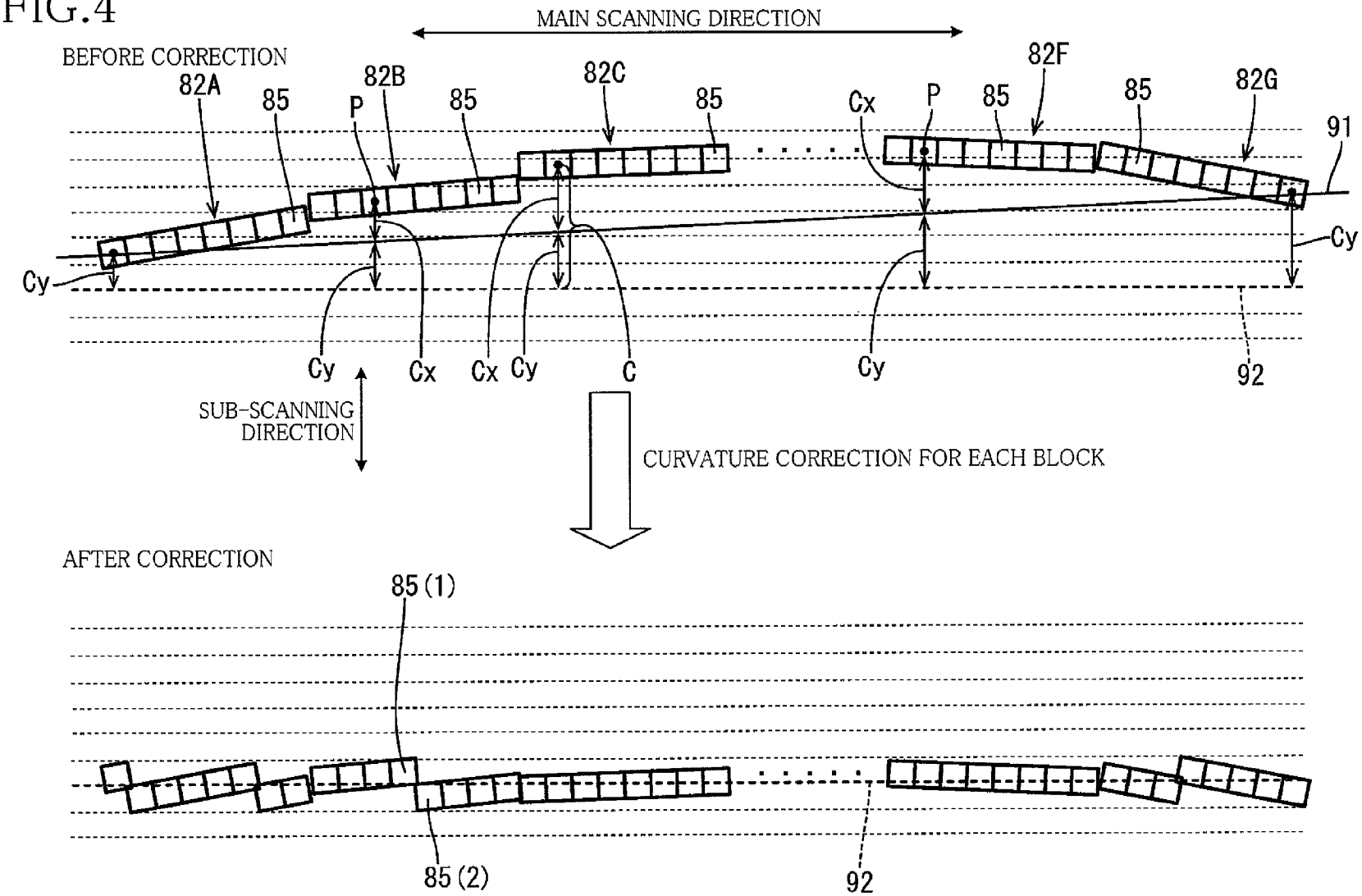
FIG. 4 is a schematic view for explaining curvature correction for each block.

There will be next explained curvature correction for each block with reference to FIG. 4. In the LED head 80, as described above, the LED chips 82 in most cases are inclined with respect to the main scanning direction and arranged so as to curve. In this first embodiment, the CPU 70A executes the curvature correction for each block to correct the inclination and the curvature.

Here, in the present embodiment, as illustrated in FIG. 4, the 256 LEDs 83 provided on one LED chips 82 are divided into eight blocks 85 each containing thirty-two LEDs 83. In general, the inclination can be ignored in the use of thirty-two LEDs 83 as a unit. Thus, in the present embodiment, each of the blocks 85 is assigned with one correction value for light emitting time point (which is a point in time when light is emitted), and the LEDs 83 contained in the same block 85 are controlled to illuminate at the same point in time.

In the LED head 80 before correction illustrated in FIG. 4, a point P is defined on each of the blocks 85, and each point P is located on a straight line connecting between the leftmost and rightmost LEDs 83 contained in a corresponding one of the blocks 85. For each of the blocks 85 in the curvature correction for each block, the controller 70 acquires: a positional misalignment amount Cx which is an amount of misalignment between the point P of the block 85 and the chip reference line 91; and a positional misalignment amount Cy which is an amount of misalignment of the chip reference line 91 with respect to the reference line 92, and then the controller 70 determines the sum of the positional misalignment amount Cx and the positional misalignment amount Cy, as a positional misalignment amount C of the block 85.

For each of the blocks 85, the controller 70 determines a correction value for the light emitting time point based on the positional misalignment amount C and stores the determined correction value into the RAM 70C.

First, the acquisition of the positional misalignment amount Cx will be explained. In the present embodiment, a manufacturer of the LED head 80 measures the positional misalignment amount Cx with respect to the chip reference line 91 for each of the blocks 85, then assembles a ROM storing the measured positional misalignment amount Cx onto the LED head 80, and ships the LED head 80. The controller 70 acquires the positional misalignment amount Cx of each block 85 by reading the positional misalignment amount Cx from the ROM assembled on the LED head 80.

Next, the acquisition of the positional misalignment amount Cy will be explained. Since the position of the LED head 80 is changed by, e.g., vibrations caused by opening and closing of the open/close cover 11, the positional misalignment amount Cy cannot be measured in advance to be stored into the ROM.

Instead, the controller 70 uses the leftmost block 85 of the leftmost LED chip 82A and the rightmost block 85 of the rightmost LED chip 82G to form patterns for detecting the positional misalignment amount Cy, on the surface of the conveyor belt 35. The controller 70 acquires the positional misalignment amount Cy for each block 85 based on detection of the formed patterns by the detector 60. A specific explanation will be given with reference to FIG. 5.

Figure 5:
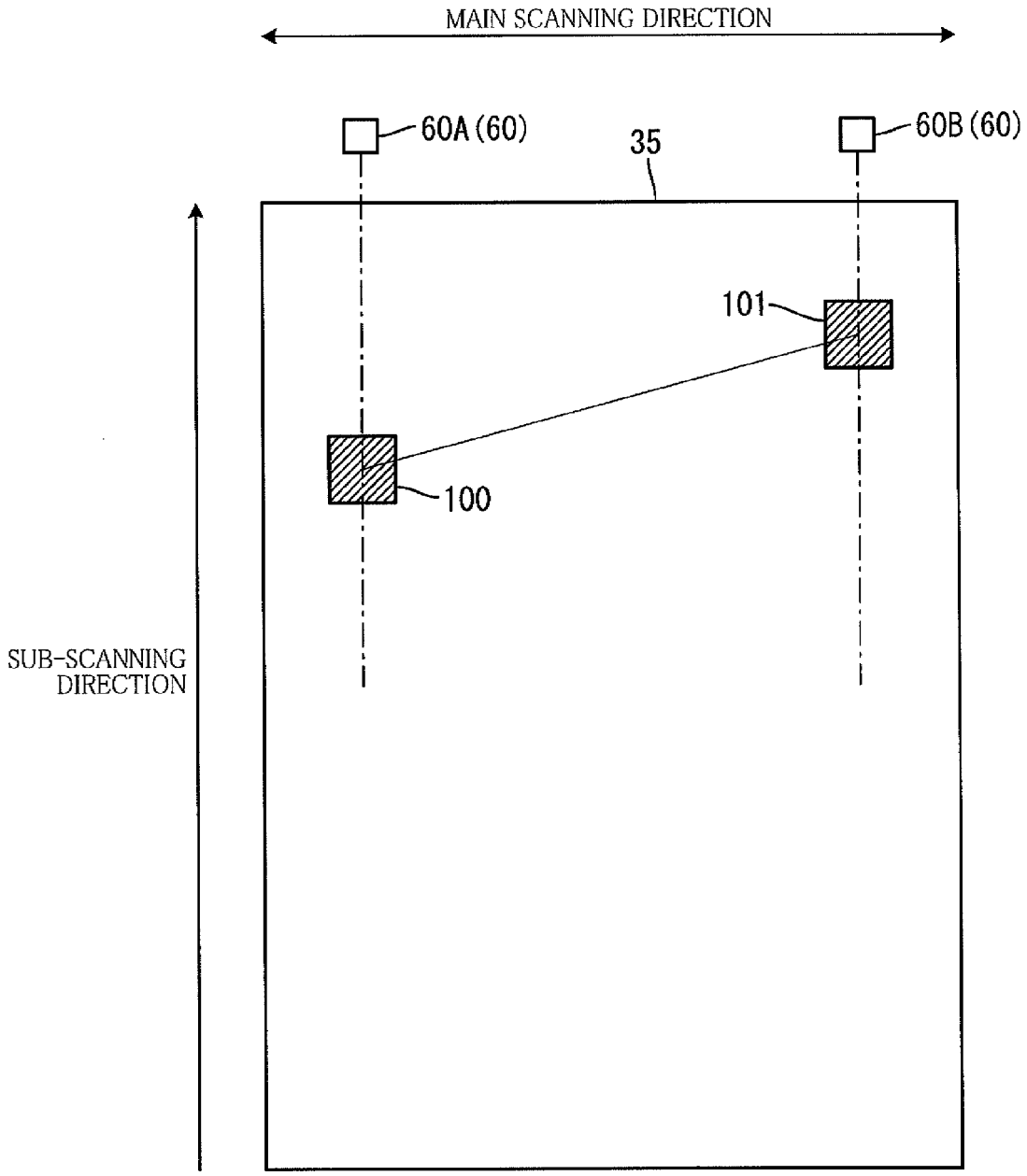
FIG. 5 is a schematic view for explaining acquisition of a positional misalignment amount Cy.

FIG. 5 illustrates patterns 100, 101. The pattern 100 is formed by the leftmost block 85 of the leftmost LED chip 82A, and the pattern 101 is formed by the rightmost block 85 of the rightmost LED chip 82G The controller 70 detects the pattern 100 using the optical sensor 60A and detects the pattern 101 using the optical sensor 60B.

The controller 70 acquires the positional misalignment amount Cy of the leftmost block 85 of the leftmost LED chip 82 by converting, into a distance, a difference in time between the time point when the pattern 100 has been detected and the time point when the pattern 100 should be detected. Likewise, the controller 70 acquires the positional misalignment amount Cy of the rightmost block 85 of the rightmost LED chip 82 by converting, into a distance, a difference in time between the time point when the pattern 101 has been detected and the time point when the pattern 101 should be detected. Consequently, the controller 70 can specify the position and inclination of the left end of the chip reference line 91.

The controller 70 calculates and obtains the positional misalignment amount Cy for each block 85 based on the position and inclination of the left end of the chip reference line 91. As a result, the controller 70 acquires the positional misalignment amount Cy for each block 85.

Figure 6:
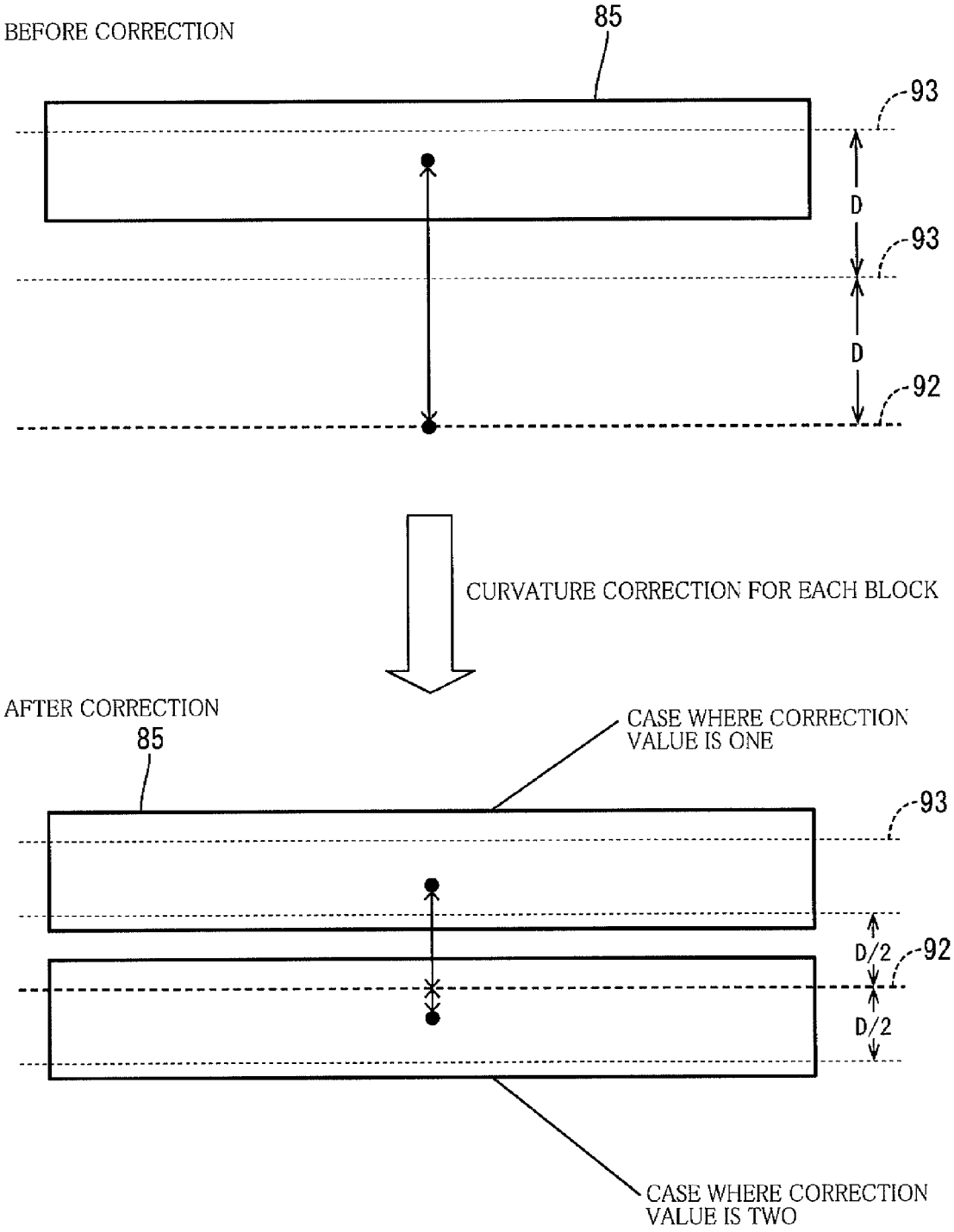
FIG. 6 is a schematic view for explaining the curvature correction for each block more specifically.

There will be next explained, with reference to FIG. 6, determination of the correction value for the light emitting time point based on the positional misalignment amount C. Here, since the inclination can be ignored in the use of thirty-two LEDs 83 as a unit as described above, FIG. 6 illustrates the block 85 in parallel with the main scanning direction for simplicity.

The following explanation is provided for a quantization distance and then for determination of the correction value. The light emitting time point for the block 85 can be changed only by one clock, at a time, of a clock signal for illuminating the LEDs 83. Thus, curvature correction can be executed only by a distance corresponding to one clock as a unit. In the present embodiment, the distance corresponding to one clock may be referred to as "quantization unit D". For visual recognition of the quantization unit D, FIG. 6 illustrates a plurality of broken lines 93 spaced apart from each other by the distance of the quantization unit D in the sub-scanning direction, with the reference line 92 used as a reference.

It is noted that FIG. 6 illustrates the broken lines 93 with a relatively long distance for easier understanding. This distance is about 10.6 μm in reality and shorter than the width of the LED chips 82 in the sub-scanning direction.

Since the curvature correction can be executed only by the quantization unit D as described above, the controller 70 temporarily determines a quotient of the positional misalignment amount C divided by the quantization unit D, as the correction value for the light emitting time point for the block 85. The controller 70 calculates and obtains the positional misalignment amount C, assuming that the light emitting time point is changed from a reference time point by the temporarily-determined correction value. In the following description, the positional misalignment amount C obtained by the calculation is referred to as "positional misalignment amount C after the correction".

When the positional misalignment amount C after the correction is less than or equal to D/2, the controller 70 determines the temporarily-determined correction value as a final correction value. When the positional misalignment amount C after the correction is greater than D/2, the controller 70 changes the temporarily-determined correction value by one such that the positional misalignment amount C after the correction becomes less than or equal to D/2.

For example, in the case where the quantization unit D is 10.6 μm, and the positional misalignment amount C of the block 85 is 19.3 μm, the quotient of the positional misalignment amount C divided by the quantization unit D is one. In this case, the positional misalignment amount C is corrected by 10.6 μm (=10.6×1) for the block 85, and the positional misalignment amount C after the correction becomes 8.7 μm (=19.3−10.6×1).

In the case where the quantization unit D is 10.6 μm, D/2 is 5.3 μm. Thus, 8.7 μm is greater than D/2. In this case, in the case where the correction value is changed by one to two, the positional misalignment amount C after the correction is 1.9 μm (=19.3−10.6×2) which is less than or equal to D/2 (=5.3). Accordingly, the final correction value is determined at two.

By executing the above-described curvature correction for each of the blocks 85, the positional misalignment amounts C are corrected as in the LED head 80 after the correction illustrated in FIG. 4.

(5) Curvature Correction for Each Block using Reference Line

As in the LED head 80 after the correction illustrated in FIG. 4, the curvature correction may cause a positional difference between adjacent two of the blocks 85. In the example illustrated in FIG. 4, a large positional difference occurs between a block 85(1) and a block 85(2) in particular.

The above-described positional difference can be reduced seemingly by the correction. In the case where a multicolored image is formed, however, if a positional difference is corrected, directions of correction may be opposite each other between colors, which may make color misalignment more noticeable. To solve this problem, in the present embodiment, a higher priority is given to reduction of the color misalignment than to reduction of the positional difference, and after the above-described curvature correction for each block, curvature correction for each block using the reference line is executed without executing the correction of the positional difference. Specific explanation will be given below.

Figure 7:
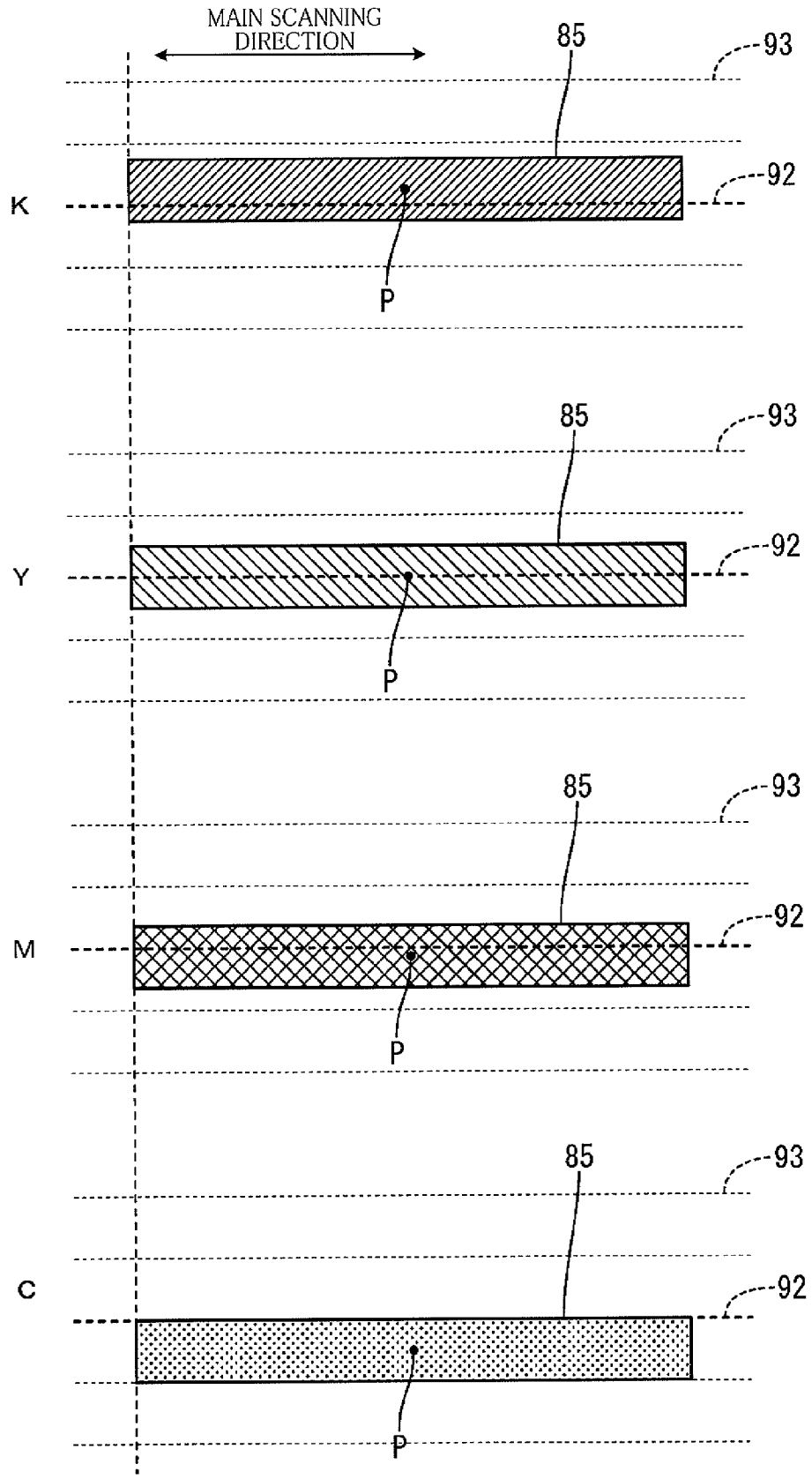
FIG. 7 is a schematic view illustrating results of the curvature correction for each block, for each color.

FIG. 7 illustrates a result of the above-described curvature correction for each block which is executed for four blocks 85 of the respective four KYMC LED heads 80, which blocks 85 are located at the same position in the main scanning direction. For example, in the case where the blocks 85 of each LED head 80 are numbered from the left side, the same position in the main scanning direction means a block 85 assigned with the same number among the four KYMC LED heads 80. In the example illustrated in FIG. 7, a distance is the longest between the block 85 for K (hereinafter may be referred to as "K block 85", and this way of reference applies to the blocks 85 for the other colors) and the C block 85 among all combinations of the KYMC blocks 85. Thus, an explanation will be provided for the K block 85 and the C block 85 as an example.

Figure 8:
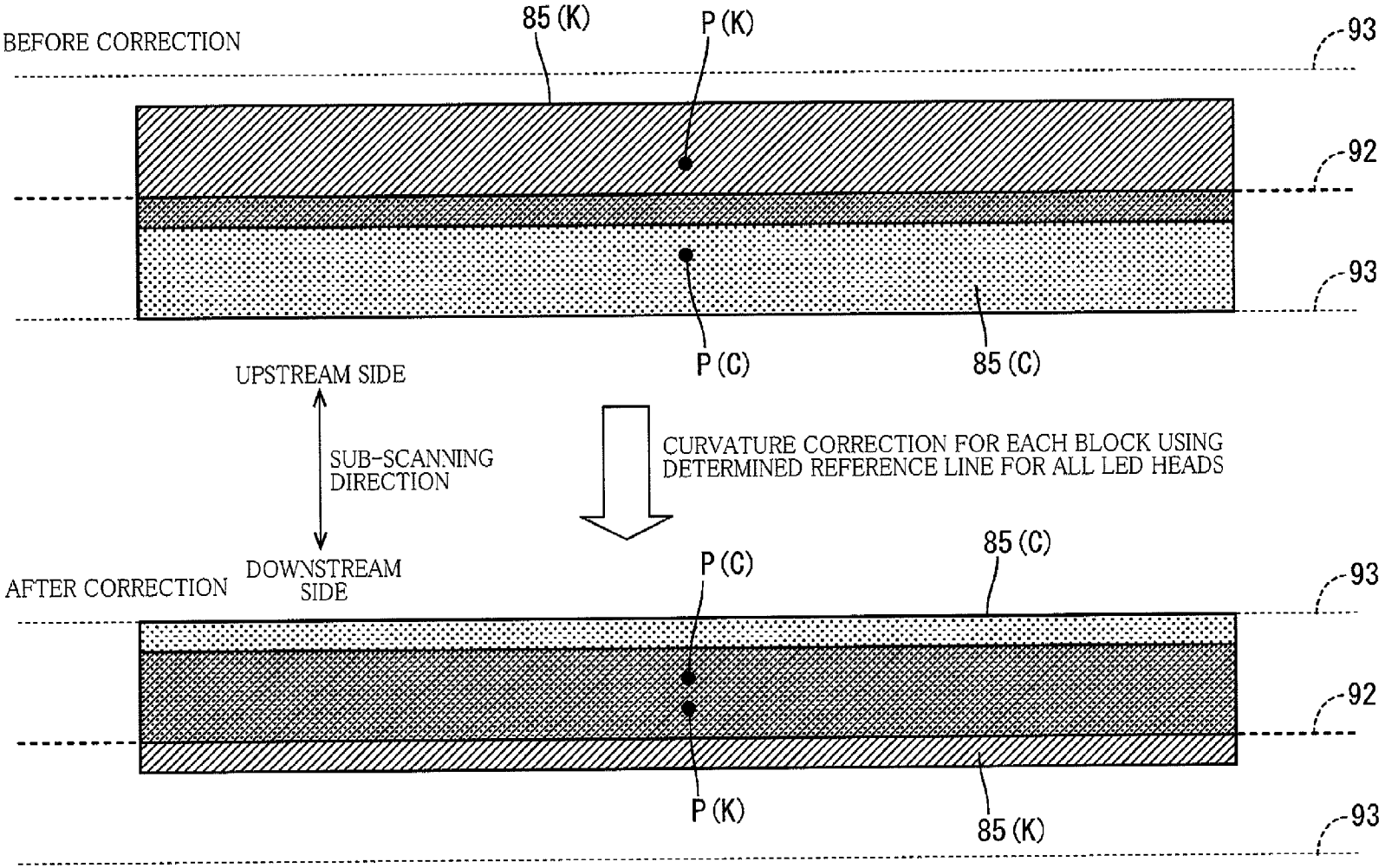
FIG. 8 is a schematic view for explaining curvature correction for each block using a reference line.

In the view illustrating the blocks before correction in FIG. 8, the K block 85 and the C block 85 illustrated in FIG. 7 are superposed on each other. In the case where a point P of the K block 85 and a point P of the C block 85 are spaced apart from each other in the sub-scanning direction, if these blocks are superposed on each other, color misalignment between black (K) and cyan (C) is deteriorated as in the view illustrating the blocks before correction in FIG. 8. To solve this problem, the CPU 70A executes the curvature correction for each block using the reference line to reduce the color misalignment. Specific explanation will be provided below.

In the view illustrating the blocks before correction in FIG. 8, for example, when it is assumed that the positional misalignment amount C of the K block 85 after the curvature correction for each block is 3.8 μm on the upstream side in the sub-scanning direction, and the positional misalignment amount C of the C block 85 is 4.2 μm on the downstream side, a distance between the point P of the K block 85 and the point P of the C block 85 in the sub-scanning direction is 8.0 μm which is greater than D/2.

In this case, the point P of the K block 85 is nearer to the reference line 92 than the point of the C block 85. In other words, the point of the C block 85 is farther form the reference line 92 than the point P of the K block 85. Thus, the CPU 70A changes a correction value for the C block 85 such that the distance between the point P of the K block 85 and the point P of the C block 85 in the sub-scanning direction becomes less than or equal to D/2.

For example, in the above-described example, in the case where the correction value for the C block 85 is changed by one toward the upstream side in the sub-scanning direction, the positional misalignment amount C of the C block 85 becomes 6.4 μm (=4.2−10.6) on the upstream side, and the distance between the point P of the K block 85 and the point P of the C block 85 in the sub-scanning direction becomes 2.6 μm (=6.4−3.8) which is less than or equal to D/2.

While the explanation has been provided for black (K) and cyan (C) for easier understanding, the above-described correction is executed for the four colors in the curvature correction for each block using the reference line. Specifically, the CPU 70A determines, as a reference, a block 85 nearest to the reference line 92 among the blocks 85 for the four colors, and then the CPU 70A changes correction values for the other three blocks 85 such that a distance in the sub-scanning direction between each of the three blocks 85 and the block 85 determined as a reference becomes less than or equal to D/2.

(6) Curvature Correction Processing

Figure 9:
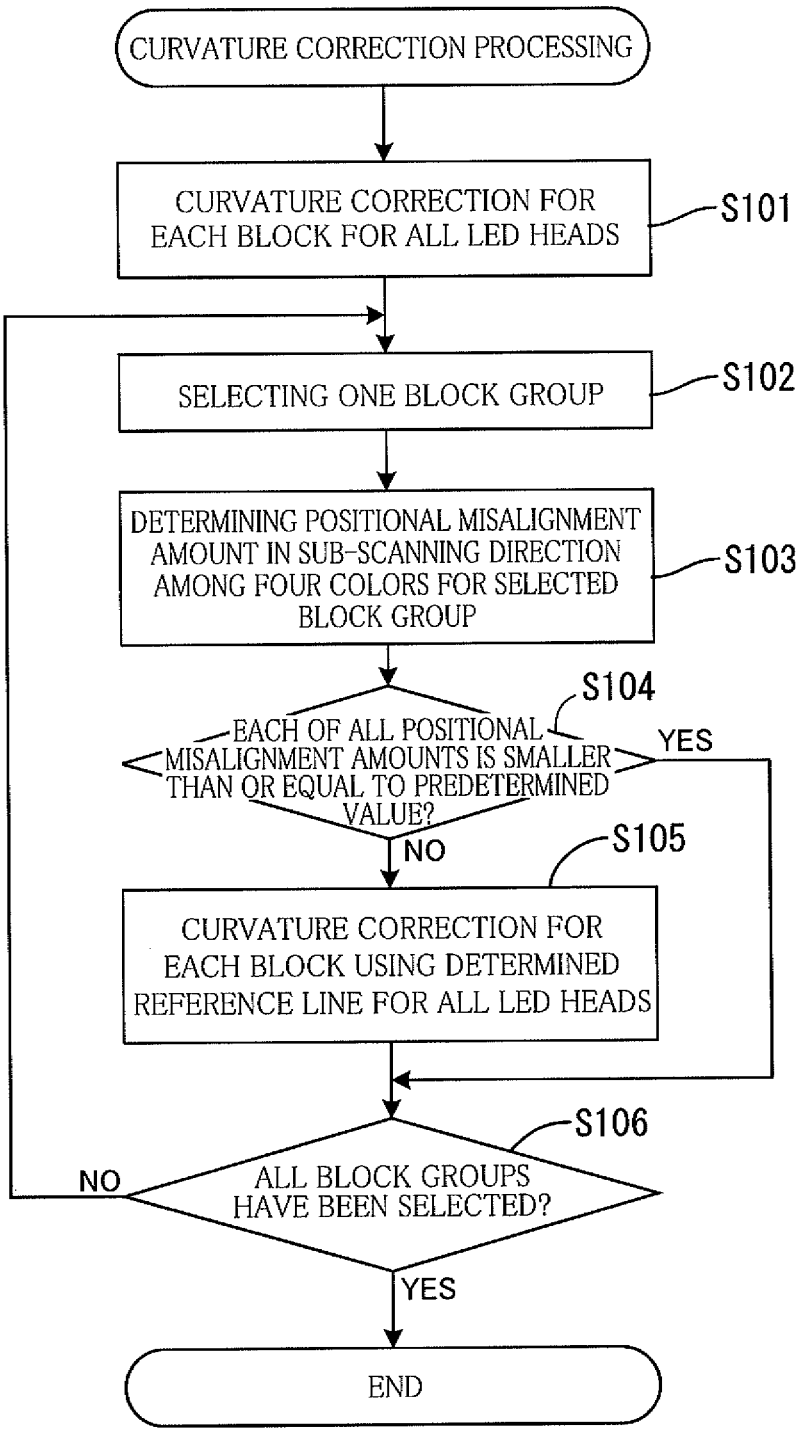
FIG. 9 is a flow chart illustrating a curvature correction processing.

There will be next explained, with reference to FIG. 9, a curvature correction processing to be executed by the CPU 70A. The curvature correction processing is a processing for executing the curvature correction for each block and the curvature correction for each block using the reference line. The curvature correction processing begins when an image forming job is received from the external device via the communication interface device 72.

It is noted that the curvature correction processing may be executed when the printer 1 is turned on, when the open/ close cover 11 is opened or closed, or when a predetermined length of time is elapsed from the last execution of the curvature correction processing.

A processing at S101 (the curvature correction for each block) and processings at S102-S106 (the curvature correction for each block using the reference line) which will be described below are not necessarily executed in the same flow and may be executed independently in different points in time. For example, the printer 1 may be configured such that only the processing at S101 (the curvature correction for each block) when the printer 1 is turned on or when the open/close cover 11 is opened or closed, and only the processings at S102-S106 (the curvature correction for each block using the reference line) when the image forming job is received.

The flow in FIG. 9 begins with S101 at which the CPU 70A executes the curvature correction for each block for the LED heads 80 respectively corresponding to all the colors. In the curvature correction for each block, as described above, the patterns are also formed on the surface of the conveyor belt 35 to acquire the positional misalignment amount Cy. The CPU 70A then stores, into the RAM 70C, the correction values determined in the curvature correction for each block. The processing at S101 is one example of a setting processing.

The CPU 70A at S102 selects a block group which is constituted by four blocks 85 of the respective LED heads 80 which are located at the same position in the main scanning direction. This selection may be performed in order from the leftmost block group to the rightmost block group or vice versa.

The CPU 70A at S103 determines a positional misalignment amount in the sub-scanning direction among the four colors for the selected block group. Specifically, the CPU 70A executes a processing for determining a distance between points P of respective two blocks 85, for all the combinations of the four blocks 85.

The CPU 70A at S104 determines whether or not each of all the positional misalignment amounts is smaller than or equal to a predetermined value. When each of all the positional misalignment amounts is smaller than or equal to the predetermined value (S104: Yes), this flow skips S105 and goes to S106. When any one of all the positional misalignment amounts is larger than the predetermined value (S104: No), this flow goes to S105. One example of the above-described predetermined value is D/2.

The CPU 70A at S105 executes the above-described curvature correction for each block using the reference line.

The CPU 70A at S106 determines whether all the block groups have been selected or not. When all the block groups have been selected, this flow ends. When all the block groups have not been selected, this flow returns to S102.

The processing at S105 is one example of a first change processing. After the completion of this flow, the CPU 70A controls the printer 1 to form an image on the recording medium M. In this control, the CPU 70A controls the LEDs 83 of each of the blocks 85 to illuminate at a light emitting time point corresponding to the correction value stored in the RAM 70C. The processing for illuminating the LEDs 83 of each of the blocks 85 at the light emitting time point corresponding to the correction value is one example of an illuminating processing.

The CPU 70A then executes a processing for developing an electrostatic latent image formed on the photoconductive drum 42C in the illuminating processing, by using the toner cartridge 50 containing toner of a color corresponding to the electrostatic latent image. This processing is one example of a developing processing.

(7) Effects of Embodiment

In the printer 1 according to the first embodiment described above, after the curvature correction for each block, the curvature correction for each block using the reference line is executed without executing the correction of the positional difference. For example, in the case where the positional difference is corrected for all the KYMC LED heads 80, the color misalignment among the four colors is 21.2 μm at the maximum. In this printer 1, on the other hand, the color misalignment among the four colors can be made 10.6 μm at the maximum. Accordingly, when compared with the case where the positional difference is corrected, the printer 1 can reduce color misalignment in the sub-scanning direction in the case where a four-color image is formed.

The printer 1 executes the curvature correction for each block (the setting processing) before the curvature correction for each block using the reference line (the first change processing). This configuration can prevent occurrence of a situation in which an image formed by illumination of the LEDs 83 contained in each of the blocks 85 is greatly displaced from the reference line 92.

In the curvature correction for each block using the reference line (the first change processing), the printer 1 changes a correction value for the block 85 located farther from the reference line 92 in the sub-scanning direction. This configuration can reduce color misalignment in the sub-scanning direction in the case where a four-color image is formed, while preventing occurrence of the situation in which the image formed by illumination of the LEDs 83 contained in each of the blocks 85 is greatly displaced from the reference line 92.

The printer 1 changes a correction value for at least one of two blocks 85 (e.g., the K block 85 and the C block 85) corresponding to two images which are spaced apart from each other by the longest distance in the sub-scanning direction in the case where four images are formed on the recording medium M using four blocks 85 constituting one block group. This configuration can effectively reduce the color misalignment.

In the printer 1, the LED head 80 is constituted by the plurality of LED chips 82 on each of which the plurality of LEDs 83 are arranged in a straight line. In each of the LED chips 82, the plurality of LEDs 83 are divided into the plurality of blocks each containing the thirty-two LEDs 83. The LED chips 82 are in some cases arranged so as to incline in the main scanning direction as described above. Effects of the inclination can be reduced by dividing the plurality of LEDs 83 into a plurality of blocks as described above.

In the printer 1, the photoconductive drums 42C are provided respectively corresponding to the LED heads 80, and the toner cartridges 50 are used in the developing processing to develop the electrostatic latent images formed on the respective photoconductive drums 42C. Providing the plurality of the photoconductive drums 42C facilitates control when compared with the case where one photoconductive drum 42C is exposed by the plurality of LED heads 80.

Second Embodiment

Figure 10:
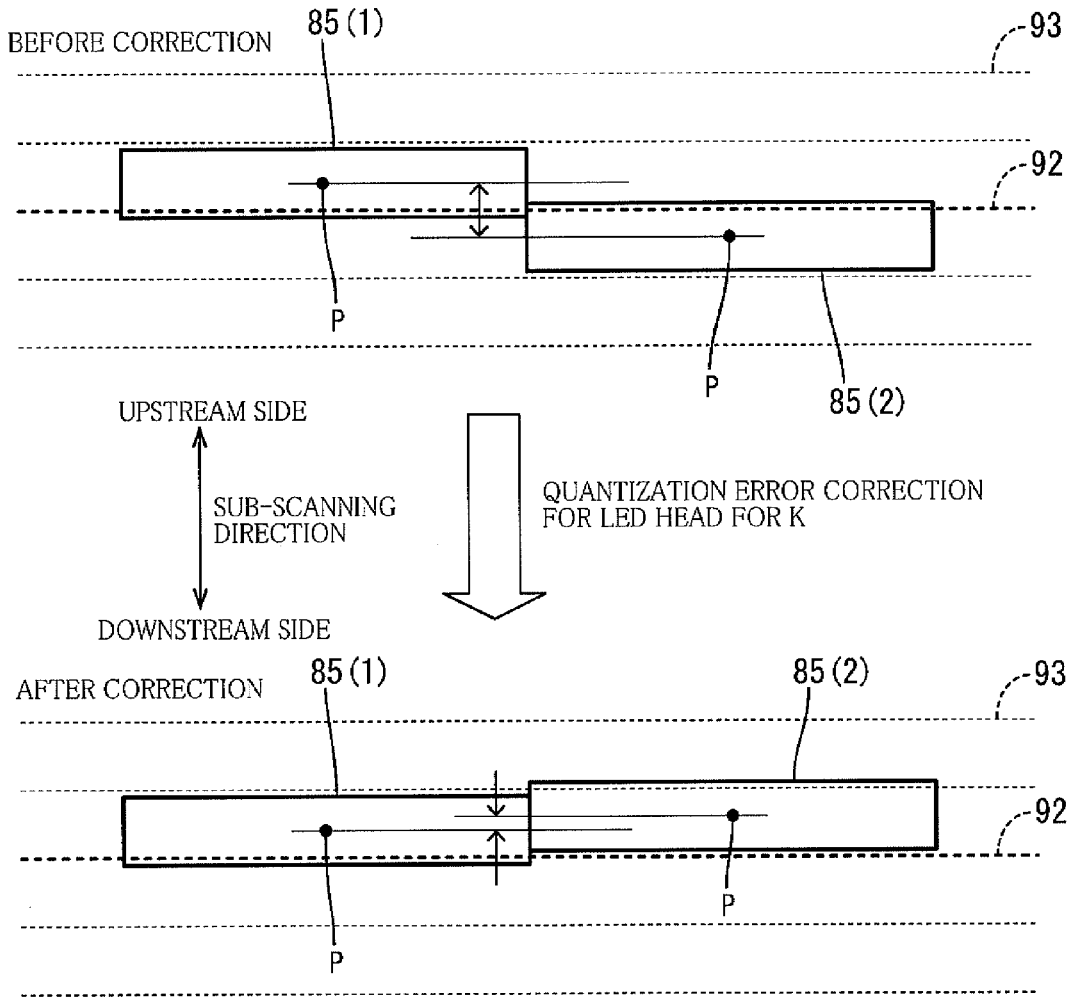
FIG. 10 is a schematic view for explaining a quantization error correction.
Figure 11:
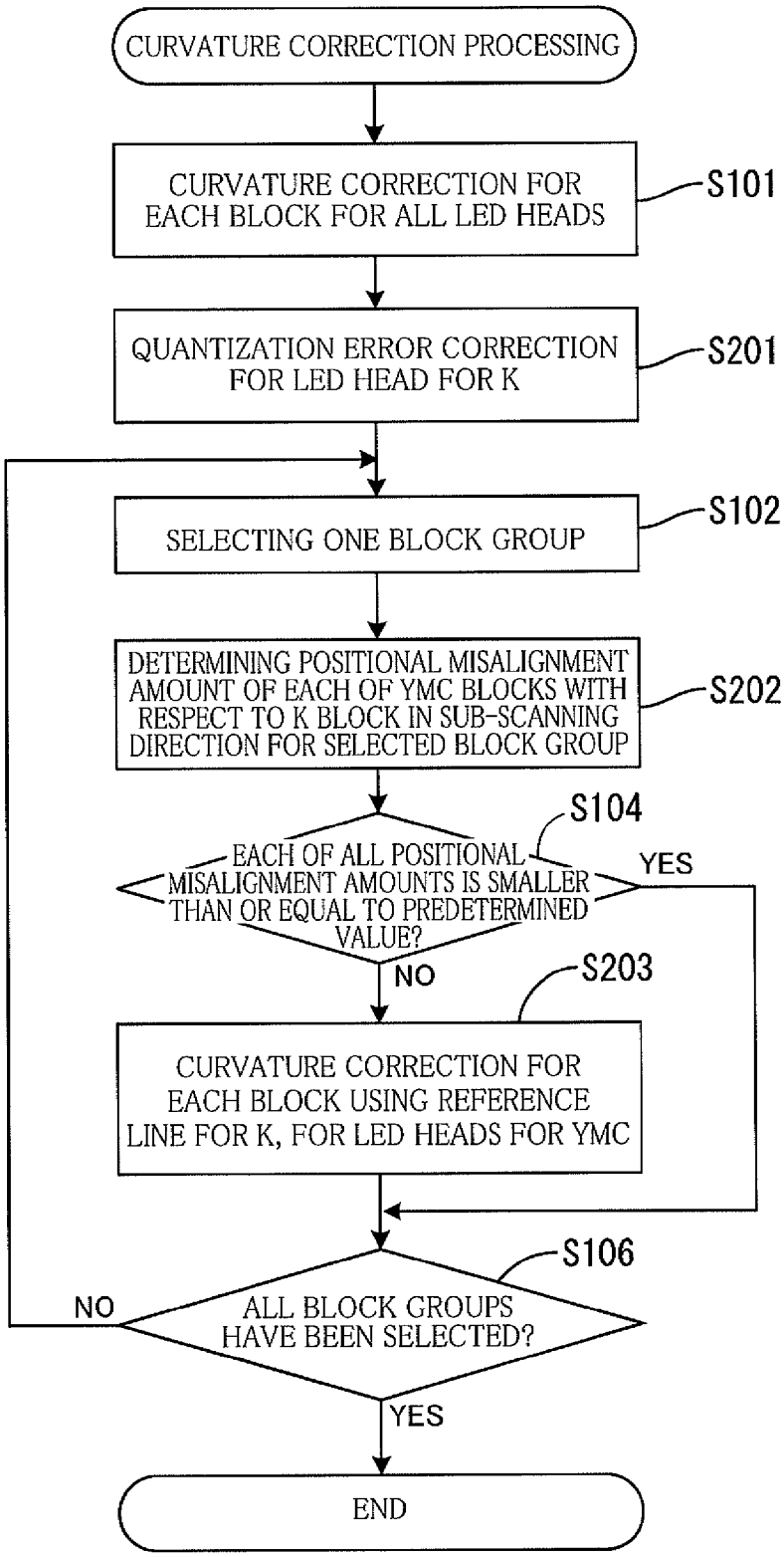
FIG. 11 is a flow chart illustrating a curvature correction processing in a second embodiment.

There will be next explained a second embodiment with reference to FIGS. 10 and 11.

In the above-described first embodiment, the curvature correction for each block using the reference line (the first change processing) is executed after the curvature correction for each block (the setting processing). In this second embodiment, after the curvature correction for each block, the controller 70 executes, for the K LED head 80, a quantization error correction which will be described below without executing the curvature correction for each block using the reference line. For each of the YMC LED heads 80, the controller 70 does not execute the quantization error correction and executes correction (the first change processing) for reducing color misalignment with reference to the K block 85 for which the quantization error correction has been executed. The quantization error correction is one example of a second change processing.

(1) Quantization Error Correction

There will be explained, with reference to with reference to FIG. 10, the quantization error correction to be executed for the K LED head 80. By executing the above-described curvature correction for each block, the positional misalignment amount C after the correction can be made less than or equal to D/2 for each of the blocks 85. However, since the curvature correction for each block is executed independently for each of the blocks 85, a difference between points P of respective adjacent two of the blocks 85 is greater than D/2 in some cases.

In the view illustrating the blocks before correction in FIG. 10, for example, a positional misalignment amount C of the block 85(1) after the curvature correction for each block is 4.8 μm on the upstream side in the sub-scanning direction, and a positional misalignment amount C of the block 85(2) after the curvature correction for each block is 3.8 μm on the downstream side.

In this case, the distance between the point P of each of the blocks 85 and the reference line 92 is less than or equal to D/2 (=5.6) μm, but the difference between the point P of the block 85(1) and the point P of the block 85(2) in the sub-scanning direction is 8.6 μm which is greater than D/2. That is, a positional difference in the sub-scanning direction between the right end of the block 85(1) and the left end of the block 85(2) is greater than D/2. In the case where a straight line extending in the main scanning direction is formed, such positional difference causes misalignment in the straight line.

In this situation, in the case where the correction value for the block 85(2) is changed by one toward the upstream side, for example, the positional misalignment amount C of the block 85(2) becomes 6.8 μm, and the difference between the points P becomes 2.0 μm. As a result, as in the view illustrating the blocks after correction in FIG. 10, the difference between the point P of the block 85(1) and the point P of the block 85(2) can be made less than or equal to D/2.

Accordingly, for the K LED head 80, the controller 70 executes the quantization error correction for changing the correction value, for each block in order from the block 85 located next to the leftmost block 85 on its right side, with reference to the leftmost block 85, for example, such that a difference in the sub-scanning direction between a point P of the block 85 and a point P of a block 85 located next thereto on its left side is less than or equal to D/2.

Here, the reason why the controller 70 executes the quantization error correction and does not execute the curvature correction for each block using the reference line for the K LED head 80 is that the straight line extending in the main scanning direction is in most cases formed by black toner. For example, a list produced with a word processor or spreadsheet software is in most cases formed by black toner. Since the controller 70 executes the quantization error correction and does not execute the curvature correction for each block using the reference line for the K LED head 80 in the present embodiment, it is possible to prevent occurrence of misalignment in the straight line extending in the main scanning direction in the case where a list or the like is produced. Black (K) is one example of a reference color.

The reason why the controller 70 does not execute the quantization error correction and executes the curvature correction for each block using the reference line for the YMC LED chips 82 is that the toner for yellow (Y), magenta (M), and cyan (C) is not often used for forming a straight line, and there is high possibility that image quality is improved more by reducing the color misalignment than by reducing the positional difference. Each of yellow (Y), magenta (M), and cyan (C) is one example of a color different from the reference color.

(2) Curvature Correction Processing

There will be next explained a curvature correction processing in the second embodiment with reference to FIG. 11. It is noted that the same numerals as used in the first embodiment are used to designate the corresponding processings in this second embodiment, and an explanation of which is dispensed with.

The CPU 70A at S201 executes the quantization error correction for the K LED head 80. The processing at S201 is one example of the second change processing.

The CPU 70A at S202 determines a positional misalignment amount of each of the YMC blocks 85 with respect to the K block 85 in the sub-scanning direction for the selected block group.

For each of yellow (Y), magenta (M), and cyan (C), when a distance in the sub-scanning direction between the point P of the block 85 and the point P of the K block 85 is greater than D/2, the CPU 70A at S203 changes the correction value such that the distance in the sub-scanning direction between the point P of the block 85 and the point P of the K block 85 becomes less than or equal to D/2. The processing at S203 is one example of the first change processing.

(3) Effects of Embodiment

In the printer 1 according to the second embodiment described above, the controller 70 changes a correction value which seemingly reduces the positional difference between the blocks 85 for the LED head 80 having formed an electrostatic latent image to be developed with the toner for K. This configuration can reduce misalignment in the straight line formed with the toner for K.

For each of yellow (Y), magenta (M), and cyan (C), the printer 1 changes the correction value such that the distance in the sub-scanning direction between the point P of the block 85 and the point P of the K block 85 is less than or equal to D/2, making it possible to reduce color misalignment of yellow (Y), magenta (M), and cyan (C) with respect to black (K).

Third Embodiment

Figure 12:
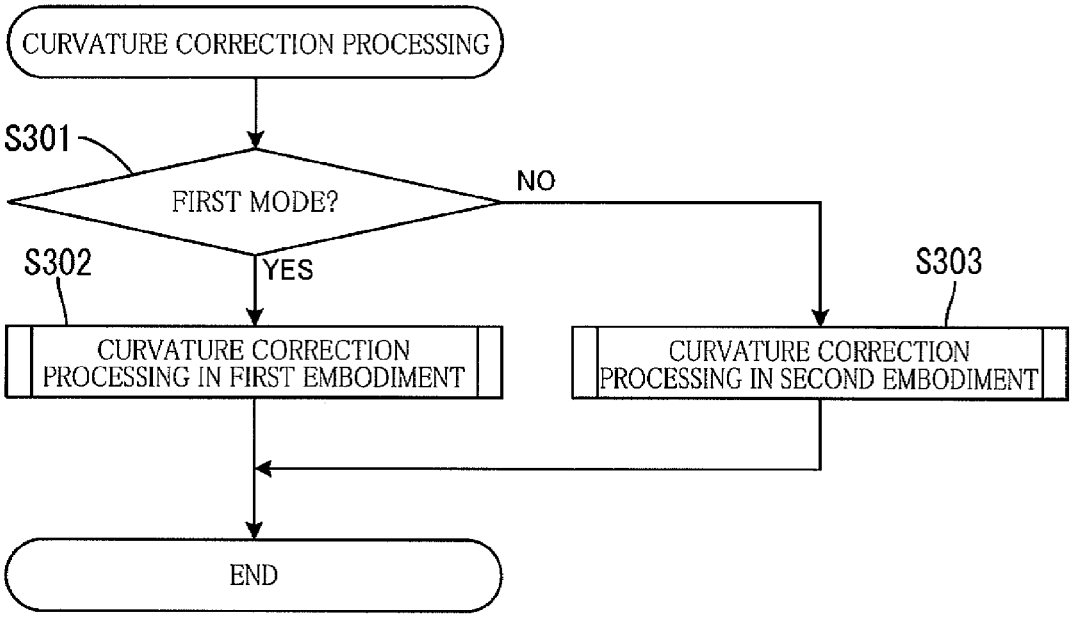
FIG. 12 is a flow chart illustrating a curvature correction processing in a third embodiment.

There will be next explained a third embodiment with reference to FIG. 12.

The third embodiment is a modification of the first embodiment and the second embodiment. In this third embodiment, the controller 70 can switch a mode of the printer 1 between a first mode in which the curvature correction in the first embodiment is executed and a second mode in which the curvature correction in the second embodiment is executed.

Specifically, the controller 70 accepts a user's selection of whether the mode of the printer 1 is to be switched to the first mode or the second mode, and then the controller 70 switches the mode of the printer 1 to the mode selected by the user. The selection may be accepted in the following manner: the user selects the first mode or the second mode with an external device when transmitting an image forming job from the external device to the printer 1, and the controller 70 accepts the selection by receiving the image forming job containing a result of the selection, from the external device. Alternatively, the selection may be accepted via the operation device 71.

There will be next explained a curvature correction processing in the third embodiment with reference to FIG. 12.

When the selected mode is the first mode (S301: Yes), this flow goes to S302. When the selected mode is not the first mode, that is, when the selected mode is the second mode (S301: No), this flow goes to S303. The processing at S301 is one example of a switch processing.

The CPU 70A at S302 executes the curvature correction processing in the first embodiment.

The CPU 70A at S303 executes the curvature correction processing in the second embodiment.

In the printer 1 according to the third embodiment described above, when the mode of the printer 1 is switched to the first mode, it is possible to reduce color misalignment among all the colors. When the mode of the printer 1 is switched to the second mode, on the other hand, it is possible to can reduce color misalignment of yellow (Y), magenta (M), and cyan (C) with respect to black (K) while preventing occurrence of misalignment in the straight line formed by the K LED head 80.

Alternative Embodiments

While the embodiments have been described above, it is to be understood that the disclosure is not limited to the details of the illustrated embodiments, but may be embodied with various changes and modifications, which may occur to those skilled in the art, without departing from the spirit and scope of the disclosure. For example, the following embodiments fall within the technical scope.

(1) While the four LED heads 80 are provided in the above-described embodiments, the number of LED heads 80 is not limited to four, and any number of LED heads 80 may be provided as long as two or more LED heads are provided.

(2) In the above-described embodiments, the plurality of LEDs 83 constituting one LED chip 82 are divided into a plurality of blocks. However, the unit of the blocks is not limited to this configuration. For example, one block may be constituted by one LED 83 and may be constituted by one LED chip 82.

The way of division into the blocks may be different among the KYMC LED heads 80. For example, the printer 1 may be configured such that one LED chip 82 is divided into eight blocks in the K LED head 80, and one LED chip 82 is divided into sixteen blocks in the Y LED head 80.

A position of a boundary between two blocks in the main scanning direction may differ among the KYMC LED chips 82. For example, a position of a boundary between two blocks of the Y LED chip 82 and a position of a boundary between two blocks of the K LED chip 82 may differ from each other in the main scanning direction by a distance corresponding to half a block. More specifically, the Y LED chip 82 may be configured such that each of the leftmost block and the rightmost block is constituted by sixteen LEDs 83, and each of the other blocks is constituted by thirty-two LEDs 83.

(3) In the first embodiment, the positional misalignment amount Cx is read from the ROM assembled on the LED head 80, to acquire the positional misalignment amount Cx of each block 85. Instead of this configuration, the printer 1 may be configured such that a pattern for detecting the positional misalignment amount Cx of each block 85 is formed on the surface of the conveyor belt 35 by the LED head 80, and the formed pattern is detected by the detector 60 to acquire the positional misalignment amount Cx. In this configuration, the detector 60 is provided for each of the blocks 85.

(4) In the second embodiment, the correction value for each of yellow (Y), magenta (M), and cyan (C) is changed such that the distance in the sub-scanning direction between the point P of the block 85 and the point P of the K block 85 is less than or equal to D/2. Instead of this configuration, the printer 1 may be configured such that a block nearest to the reference line 92 among the blocks for yellow (Y), magenta (M), and cyan (C) is set as a reference for each of yellow (Y), magenta (M), and cyan (C) without setting the K block 85 as a reference, and the controller 70 changes the correction value for the blocks 85 for YMC colors other than the color of the reference block such that the distance in the sub-scanning direction between the point P of the block 85 and the point P of the block 85 as the reference is less than or equal to D/2. Also, the curvature correction using the reference line is executed in the above-described embodiments, but instead of this configuration, the printer 1 may be configured such that a block farther from the reference line 92 among the blocks is set as a reference, and the controller 70 executes curvature correction by changing a correction value for the block which is nearer to the reference line 92.

(5) In the above-described embodiments, the LED chips 82 are arranged in a straight line on one LED head 80, but the present invention is not limited to this configuration. For example, the printer 1 may be configured such that the plurality of LED chips 82 are arranged in a staggered configuration in which in the case where numbers starting from one are respectively assigned with the plurality of LED chips 82 constituting one LED head 80 in order from the left, odd-numbered LED chips 82 and even-numbered LED chips 82 are displaced from each other in the sub-scanning direction, and such that the odd-numbered LED chips 82 and the even-numbered LED chips 82 partly overlap each other in the main scanning direction.

With this configuration, in the case where forming the LEDs 83 on an edge portion of the LED chip 82 is difficult, it is possible to eliminate a space in the main scanning direction between the LED 83 disposed on one end portion of a certain LED chip 82 and the LED 83 disposed on the other end portion of the LED chip 82 adjacent to the one end portion of the certain LED chip 82, resulting in increase in density of all the LEDs 83 when viewed in the main scanning direction.

(6) In the above-described embodiments, the printer 1 as one example of the image forming apparatus includes the photoconductive drums 42C provided respectively for the LED heads 80. Instead of this type of printer 1, an image forming apparatus capable of using image on image development may be employed which includes a plurality of LED heads 80 for exposing one photoconductive drum.

(7) In the above-described embodiments, the CPU 70A executes each of the processings. Instead of this configuration, these processings may be partly executed by the ASIC 70D. Also, the controller 70 may not include the ASIC 70D. Also, the controller 70 may include a plurality of CPUs each of which executes a corresponding one or ones of the above-described processings.

What is claimed is:

1. An image forming apparatus, comprising:

a plurality of exposing units each comprising a plurality of light emitting elements arranged in a main scanning direction, the plurality of light emitting elements being divided into a plurality of blocks each containing at least one light emitting element, all of the at least one light emitting element illuminating at a light emitting time point set for said each of the plurality of blocks;

a photoconductor;

a plurality of developing units each comprising a developing material of a set specific color; and a controller configured to execute:

a first change processing in which the controller makes a change in a light emitting time point for one of two blocks contained in respective two exposing units of the plurality of exposing units and located at an identical position in the main scanning direction, such that an image distance which is a distance in a sub-scanning direction between two images each to be formed by illumination of at least one light emitting element contained in a corresponding one of the two blocks at a corresponding one of light emitting time points is less when the at least one light emitting element illuminates at a light emitting time point obtained by the change than when the at least one light emitting element illuminates at a light emitting time point which is not changed by the change;

an illuminating processing in which the controller controls the plurality of light emitting elements of each of the plurality of exposing units to illuminate at light emitting time points comprising the light emitting time point obtained by the change; and a developing processing in which the controller causes each of electrostatic latent images formed on the photoconductor in the illuminating processing to be developed with a developing material of the set specific color which is comprised in a corresponding one of the plurality of developing units, wherein each of the plurality of exposing units comprises a plurality of light emitting chips each comprising the plurality of light emitting elements arranged in a straight line, wherein the plurality of light emitting chips respectively correspond to the plurality of blocks, wherein the plurality of exposing units comprises a first exposing unit configured to form an electrostatic latent image which is to be developed with a developing material of a reference color, wherein the plurality of blocks of the first exposing unit comprises a first block and a second block, and a first end portion of the first block and a second end portion of the second block are adjacent to each other, wherein the controller is configured to execute a second change processing in which the controller changes a light emitting time point for at least one of the plurality of blocks of the first exposing unit, before execution of the first change processing, so as to reduce an error caused by a positional difference between the first end portion and the second end portion in the sub-scanning direction, wherein the plurality of exposing units are at least three exposing units, wherein the at least three exposing units respectively comprise at least three blocks located at an identical position in the main scanning direction, and wherein the controller is configured to execute a switch processing in which the controller switches between (i) a first mode in which the controller executes the first change processing and does not execute the second change processing for the at least three blocks and (ii) a second mode in which the controller executes the second change processing and does not execute the first change processing for the block of the first exposing unit among the at least three blocks, and the controller executes the first change processing for the at least three blocks other than the block of the first exposing unit.

2. The image forming apparatus according to claim 1, wherein the controller is configured to execute a setting processing in which the controller sets the light emitting time point for each of the two blocks, before execution of the first change processing, based on a distance in the sub-scanning direction between each of the two blocks and a reference line extending in a direction parallel to the main scanning direction.

3. The image forming apparatus according to claim 1, wherein the controller is configured to, in the first change processing, change a light emitting time point for one of the two blocks contained in the respective two exposing units and located at the identical position in the main scanning direction, and the one of the two blocks is farther from a reference line extending in a direction parallel to the main scanning direction than another of the two blocks.

4. The image forming apparatus according to claim 1, wherein the controller is configured to, in the first change processing, change at least two light emitting time points respectively for at least two images of at least three images to be respectively formed at least three light emitting time points for the at least three blocks, and wherein the at least two images of the at least three images differ from one of the at least three images which is nearest to a reference line extending in a direction parallel to the main scanning direction among the at least three images.

5. The image forming apparatus according to claim 1, wherein the controller is configured to, in the first change processing, change a light emitting time point for at least one of the two blocks for which the image distance determined by light emitting time points is greatest among a plurality of pairs of the plurality of blocks of each of any two of the at least three exposing units.

6. The image forming apparatus according to claim 1, wherein the plurality of exposing units comprises a second exposing unit configured to form an electrostatic latent image which is to be developed with a developing material of a color different from the reference color, wherein the two blocks in the first change processing are a block of the first exposing unit and a block of the second exposing unit, and wherein the controller is configured to, in the first change processing, change a light emitting time point for the block of the second exposing unit.

7. The image forming apparatus according to claim 1, further comprising a plurality of photoconductors, each as the photoconductor, provided respectively corresponding to the plurality of exposing units, and wherein the controller is configured to, in the developing processing, control each of the plurality of developing units to develop the electrostatic latent image formed on a corresponding one of the plurality of photoconductors.

8. The image forming apparatus according to claim 1, wherein the controller comprises a processor, and wherein when executed by the processor, a plurality of instructions stored in a memory cause the image forming apparatus to execute the first change processing, the illuminating processing, and the developing processing.

* * * * *